US010173127B2

(12) United States Patent
Chazen

(10) Patent No.: US 10,173,127 B2
(45) Date of Patent: Jan. 8, 2019

(54) STUDDED JIGSAW PUZZLE

(71) Applicant: Margo Sheryl Chazen, Las Vegas, NV (US)

(72) Inventor: Margo Sheryl Chazen, Las Vegas, NV (US)

( * ) Notice: Subject to any disclaimer, the term of this patent is extended or adjusted under 35 U.S.C. 154(b) by 0 days.

(21) Appl. No.: 15/649,202

(22) Filed: Jul. 13, 2017

(65) Prior Publication Data

US 2017/0304716 A1 Oct. 26, 2017

Related U.S. Application Data

(63) Continuation-in-part of application No. 15/233,814, filed on Aug. 10, 2016, now Pat. No. 9,724,595.

(60) Provisional application No. 62/202,910, filed on Aug. 10, 2015.

(51) Int. Cl.

| | |
|---|---|
| ***A63F 9/10*** | (2006.01) |
| *A63F 11/00* | (2006.01) |
| *A63F 3/00* | (2006.01) |
| *A63F 9/00* | (2006.01) |

(52) U.S. Cl.

CPC ..... *A63F 9/10* (2013.01); *A63F 9/1044* (2013.01); *A63F 2003/00388* (2013.01); *A63F 2003/00899* (2013.01); *A63F 2003/00933* (2013.01); *A63F 2009/0032* (2013.01); *A63F 2009/105* (2013.01); *A63F 2009/1022* (2013.01); *A63F 2011/0039* (2013.01)

(58) Field of Classification Search

CPC .. A63F 9/10; A63F 9/1044; A63F 2011/0039; A63F 2009/105; A63F 2009/1022; A63F 2009/1077; A63H 33/108; A63H 33/04; A63H 33/08; A63H 33/086

See application file for complete search history.

(56) References Cited

U.S. PATENT DOCUMENTS

| | | | | |
|---|---|---|---|---|
| 941,680 A | | 11/1909 | Houghton | |
| 1,947,947 A | | 4/1933 | Liebl | |
| 3,242,594 A | | 3/1966 | Smith | |
| 3,594,940 A | | 7/1971 | Yonezawa | |
| 3,713,246 A | * | 1/1973 | Kilroy, Jr. ..... | A63H 33/108 411/439 |
| 4,809,980 A | | 3/1989 | Bertrand | |
| 4,986,756 A | | 1/1991 | Yamguchi | |
| 4,993,984 A | | 2/1991 | Matarese | |
| 5,088,951 A | * | 2/1992 | Majurinen ..... | A63H 33/046 446/118 |

(Continued)

*Primary Examiner* — Steven Wong

(74) *Attorney, Agent, or Firm* — Connie R. Masters

(57) ABSTRACT

The jigsaw puzzle includes a baseplate used with attachable puzzle pieces. The baseplate has multiple upward-facing engagement mechanisms that are engaged with corresponding and complementary puzzle piece rear-facing engagement mechanisms. The rear-facing engagement mechanisms and the complementary puzzle piece rear-facing engagement mechanisms are designed so as to leave a space between the bottom of the puzzle piece and the top surface of the baseplate to facilitate removal of the puzzle pieces. An optional pry tool can be inserted in to the space to easily remove the puzzle pieces after play, storage, or display. An optional hanger/joiner can be utilized to hang the completed puzzle vertically and/or to join two baseplates to create increased play opportunities.

16 Claims, 12 Drawing Sheets

(56) References Cited

U.S. PATENT DOCUMENTS

| | | | | |
|---|---|---|---|---|
| 5,127,652 | A | 7/1992 | Unger | |
| 5,349,734 | A * | 9/1994 | Poulsen | A63H 33/04 29/239 |
| 5,820,124 | A | 10/1998 | Lawrence | |
| 6,015,150 | A | 1/2000 | Giguere | |
| 6,648,715 | B2 | 11/2003 | Wiens et al. | |
| 9,724,595 | B2 * | 8/2017 | Chazen | A63F 9/10 |
| 2003/0173738 | A1 | 9/2003 | Simmons | |
| 2005/0227573 | A1 | 10/2005 | Lin | |
| 2006/0163811 | A1 | 7/2006 | Chuang | |
| 2007/0266911 | A1 * | 11/2007 | Lee | A47B 25/00 108/64 |
| 2017/0036103 | A1 | 2/2017 | Chazen | |
| 2017/0304716 | A1 * | 10/2017 | Chazen | A63F 9/10 |

* cited by examiner

STUDDED JIGSAW PUZZLE

CROSS-REFERENCE TO RELATED APPLICATIONS

This continuation-in-part application claims the benefit of co-pending U.S. patent application Ser. No. 15/233,814 that was filed on Aug. 10, 2016, which claimed priority to U.S. Provisional Patent Application No. 62/202,910 that was filed on Aug. 10, 2015, which are both incorporated herein in their entirety.

FIELD OF INVENTION

This invention relates generally to puzzles, and, more particularly, to a jigsaw puzzle with pieces having rear attachment mechanisms for attachment to a baseplate.

BACKGROUND OF THE INVENTION

Puzzles have an artistic and educational appeal as well as presenting an intellectual challenge. Typically, puzzles are assembled by matching a number of interlocking irregularly cut puzzle pieces to form a planar pictorial illustration on the surface of the puzzle. The assembling of a puzzle by a child user enhances physical skills (hand-eye coordination, fine motor skills), cognitive skills (visual discrimination, sorting, classifying, analyzing, deducing), and emotional skills (patience with a reward for completion) as well as providing play value.

However, storage of puzzles with an associated set of puzzle pieces is problematic for parents, schools, child care facilities, and the like, because pieces often become lost or mixed with other sets of puzzle pieces. Storing them as a cohesive unit would be advantageous.

Display of a finished puzzle provides similar challenges. Though the pieces of a finished puzzle can be glued together or fixedly attached to a puzzle base for display (such as by permanently gluing the puzzle pieces to the base, thereby preventing detachment and allowing vertical display on a wall), this operation precludes repeat assembly. Therefore, the skill enhancement opportunities and play value of the puzzle are limited.

Further, a single baseplate may not be as large as desired, and it would, therefore, be advantageous to connect two or more baseplates for enhanced play value. Or it may be advantageous to reduce shipping costs by shipping two or more baseplates that are connected before putting the puzzle together.

Therefore, there is a need for a puzzle that provides amusement and an educational challenge for the child user while providing pieces that are easily attachable to create a cohesive unit for storage or display and are releasable for repeat play and that optionally enables the connection of multiple baseplates.

BRIEF SUMMARY OF THE INVENTION

The present invention is directed to a jigsaw-type puzzle that has shaped pieces which are interlocked to form a completed planar or non-planar front presentation (typically a pictorial or graphical illustration on the front surface of the puzzle), but adds the additional advantage that the individual pieces can be snapped down onto a plastic studded rear baseplate for storage or display. This provides the advantages that the pieces don't become misplaced between uses or fall out when displayed vertically. Yet, the pieces can be released for play again and again either by manual removal or by utilizing the optional pry tool. Additionally, a hanger/joiner may be provided for joining multiple baseplates or hanging one or multiple baseplates.

The studded jigsaw puzzle system includes at least multiple puzzle pieces and a baseplate, plus may optionally include a separate pry tool for puzzle piece removal and/or a separable hanger/joiner for joining multiple baseplates or for hanging one or multiple joined baseplates.

The baseplate includes a broad, planar base portion with front and back surfaces extending between lateral and longitudinal edges. The front surface carries multiple upwardly-extending baseplate engagement mechanisms, which are termed "male studs."

The puzzle pieces have a front and back surface and outer shaped edges. One or multiple puzzle piece engagement mechanisms are disposed on the back surface of each puzzle piece. The at least one puzzle piece engagement mechanism correlates with at least one complementary male stud disposed on the top of the baseplate. For example, puzzle piece engagement mechanisms on the puzzle pieces may fit between male studs on the baseplate, may fit onto the male studs, or may be otherwise frictionally engaged with the male studs.

Importantly, the puzzle piece engagement mechanism and the baseplate male studs are configured to prevent the bottom of the puzzle piece from abutting the front planar surface of the baseplate. Because the puzzle piece rear-facing engagement mechanisms are taller than the baseplate's male studs, a narrow space or gap is created between the bottom of the puzzle piece and the top of the baseplate front surface. This narrow gap running under the back surfaces of the puzzle pieces facilitates the lifting of the edge of any selected puzzle piece away from the baseplate to disengage the complementary engagement mechanism or mechanisms and remove the puzzle piece. This removal may be performed by use of the pry tool or manually without a tool, such as by use of the fingertip of the user.

An object of the present invention is to provide convenient storage and display of puzzle pieces by allowing the puzzle pieces to be attached to a baseplate and to be released from the baseplate.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a jigsaw-type puzzle having shaped puzzle pieces 500 that can be easily attached to a baseplate 510, but are readily removable due to a small space remaining under the attached puzzle pieces. The jigsaw puzzle described here has all the educational value of a conventional jigsaw puzzle, but increases the play value by adding a fun and easy means and method of puzzle piece removal. It provides the advantages of attachable pieces for convenient storage and/or display and of repeated use of the same puzzle due to the ability to repeatedly separate the pieces from the baseplate. Optionally, a pry tool and methods of use that enable the easy detachment of the pieces after storage or display may be provided. And optionally, a hanger/joiner accessory 530 for joining multiple baseplates 510 or hanging one or more baseplates may be provided.

Figure 2:
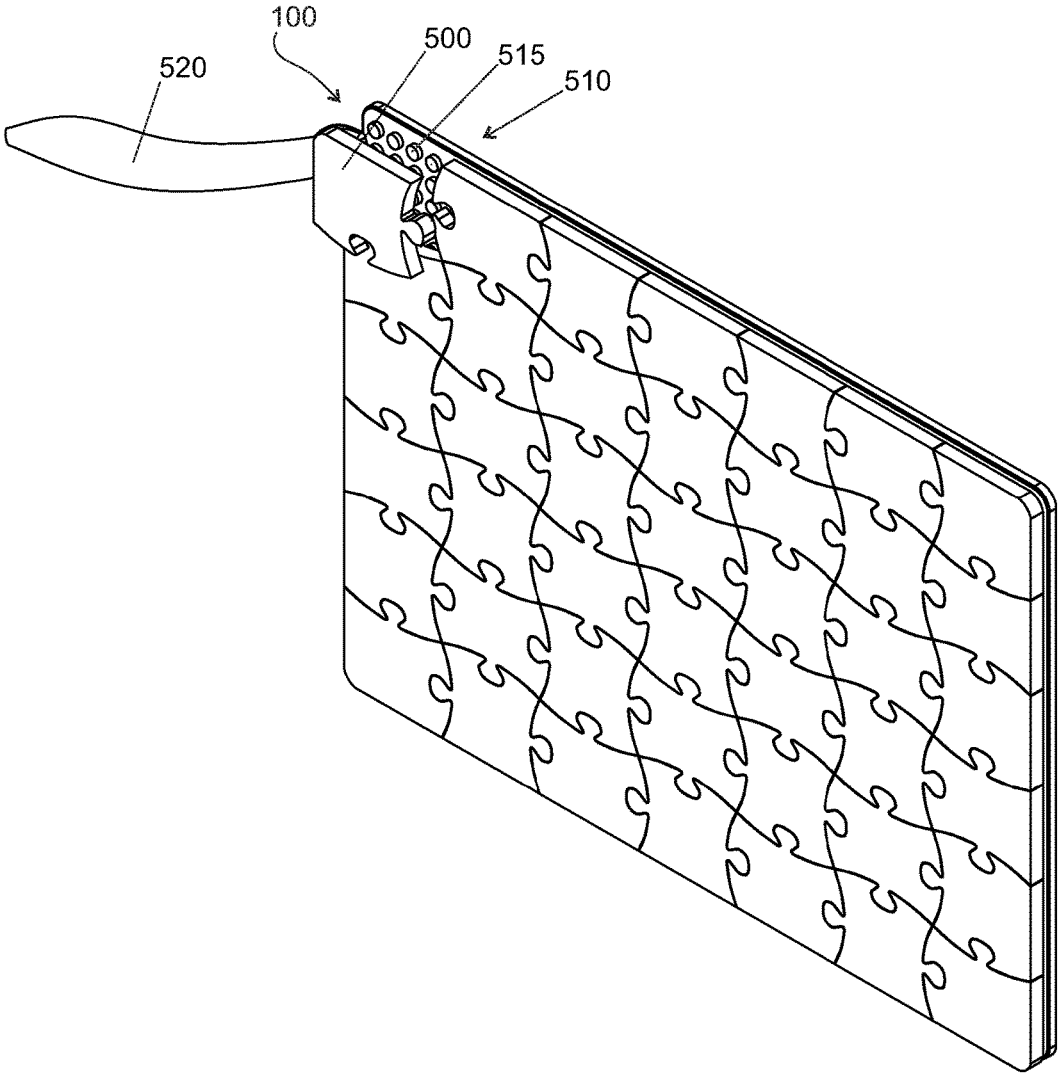
FIG. 2 is a front perspective view of an embodiment of the assembled jigsaw puzzle of the present invention, showing removal of a puzzle piece by a pry tool.
Figure 12:
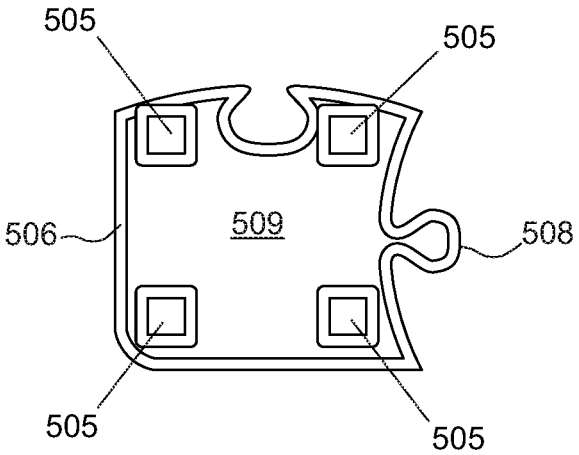
FIG. 12 is a back view of a single puzzle piece of the present invention.

The studded jigsaw puzzle system 100 (FIG. 2) of the invention includes at least multiple shaped puzzle pieces 500 and a baseplate 510, and, optionally, a pry tool 520 and/or a separable hanger/joiner 530. Each puzzle piece 500 has one or multiple puzzle piece engagement mechanisms 505 that extend downwardly from the back surface 509 (FIG. 12) of the puzzle piece. When a puzzle piece is positioned in the correct location (or otherwise over the baseplate 510), the puzzle piece can be manually pushed downward, and the puzzle piece engagement mechanism or mechanisms 505 are frictionally engaged to complementary baseplate engagement mechanism or mechanisms, termed "male studs 515," that protrude upwardly from the front of the baseplate 510.

Figure 3:
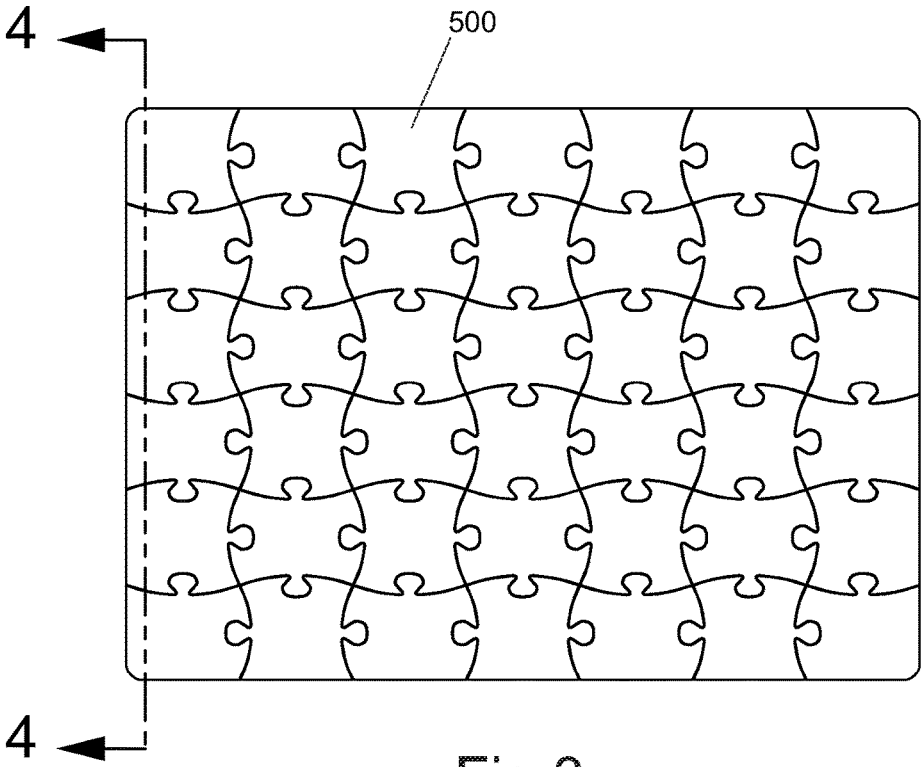
FIG. 3 is a front view of the first embodiment of the jigsaw puzzle of the present invention.
Figure 4:
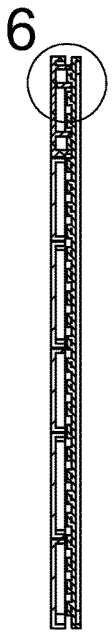
FIG. 4 is a view taken along viewing line 4 of FIG. 3 of an embodiment of the jigsaw puzzle of the present invention.
Figure 5:
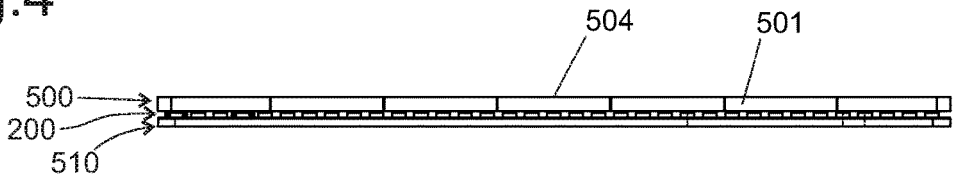
FIG. 5 is a side view of FIG. 3.
Figure 6:
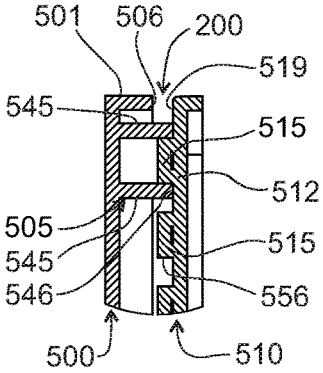
FIG. 6 is a detail view taken from circle 6 of FIG. 4.
Figure 7:
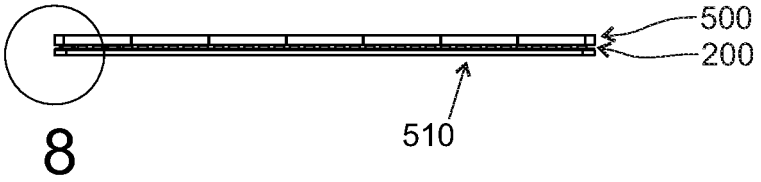
FIG. 7 is a side view of an embodiment of the present invention.
Figure 8:
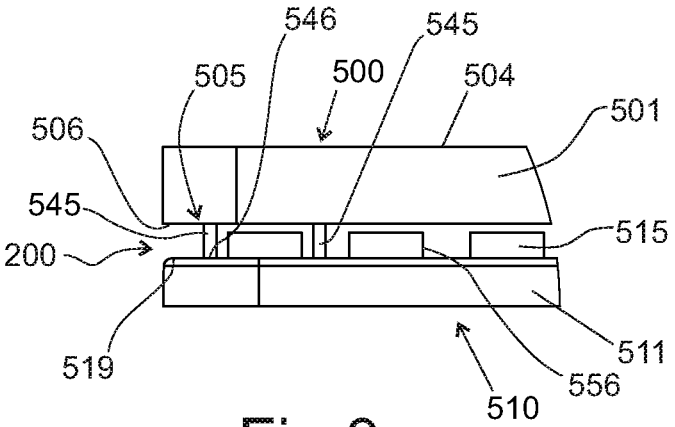
FIG. 8 is a detail of a portion of the side view of FIG. 7, the portion indicated by the circle 8 of FIG. 7.
Figure 13:
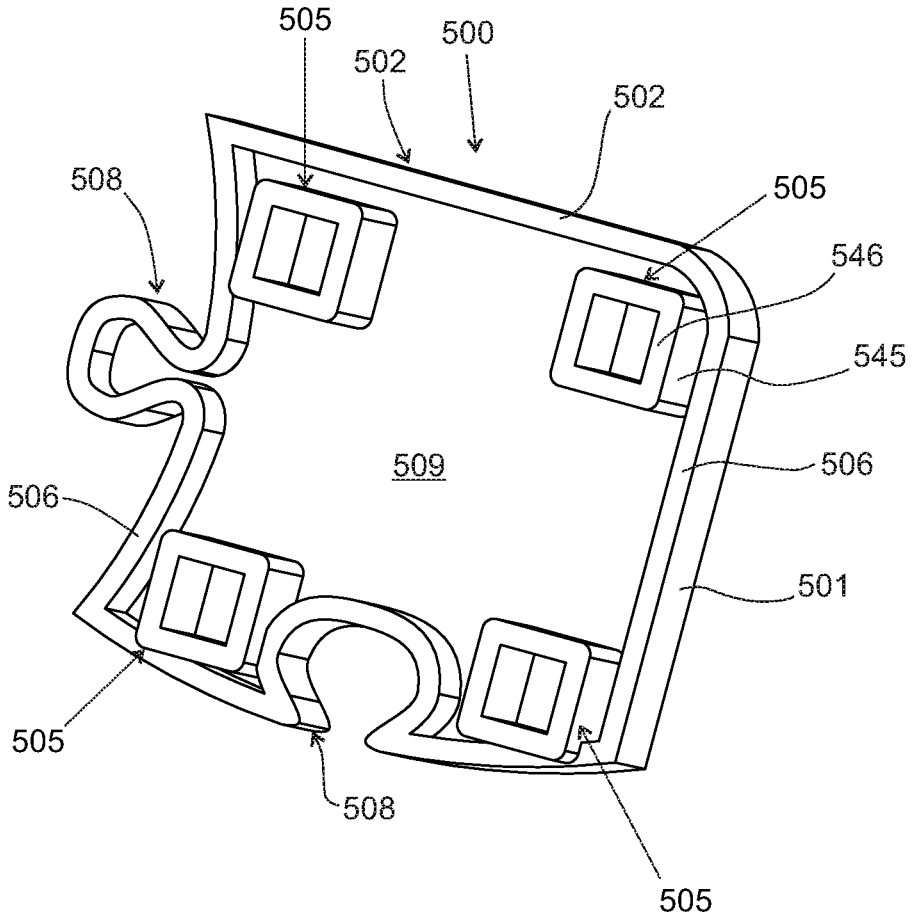
FIG. 13 is a back perspective view of a single puzzle piece of the present invention.
Figure 15:
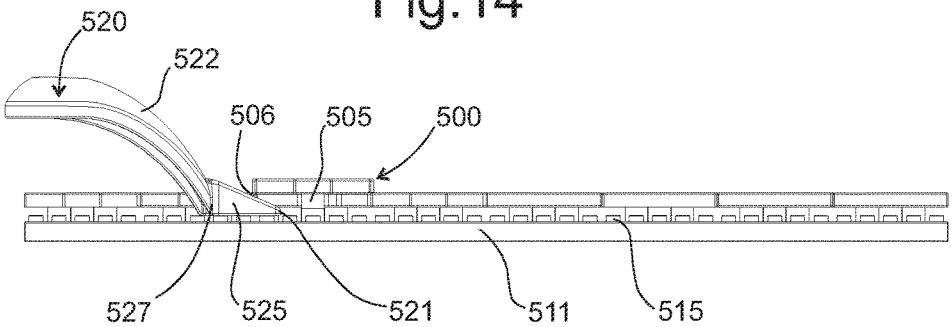
FIG. 15 is a side view of a pry tool removing puzzle pieces of an embodiment of the present invention.

In overview, because the puzzle piece engagement mechanism 505 includes a downwardly-protruding leg 545 (FIG. 13) that has a height greater than the height of the upwardly-protruding portion 556 (FIG. 6) of the male stud 515, even when the puzzle piece is pushed firmly downward, a gap 200 (FIGS. 3, 5, 8) remains between the back of the puzzle piece and the front of the baseplate. When the user desires to remove the attached puzzle piece, this gap 200 facilitates removal of the piece, which may be done manually (by using the tip of a finger or the edge of a puzzle piece or the like) or may be done by using the tip 521 (FIGS. 15, 27) of the pry tool 520, which is inserted into gap 200, which extends under the entire puzzle piece and under any other attached puzzle pieces. When using the pry tool 520, the handle 522 of the pry tool 520 is manually pushed downward, which lifts upward on a puzzle piece bottom edge (typically, the bottom edge 506 of puzzle piece side flange 501), thereby disengaging the puzzle piece engagement mechanism 505 from the male stud 515.

Figure 14:
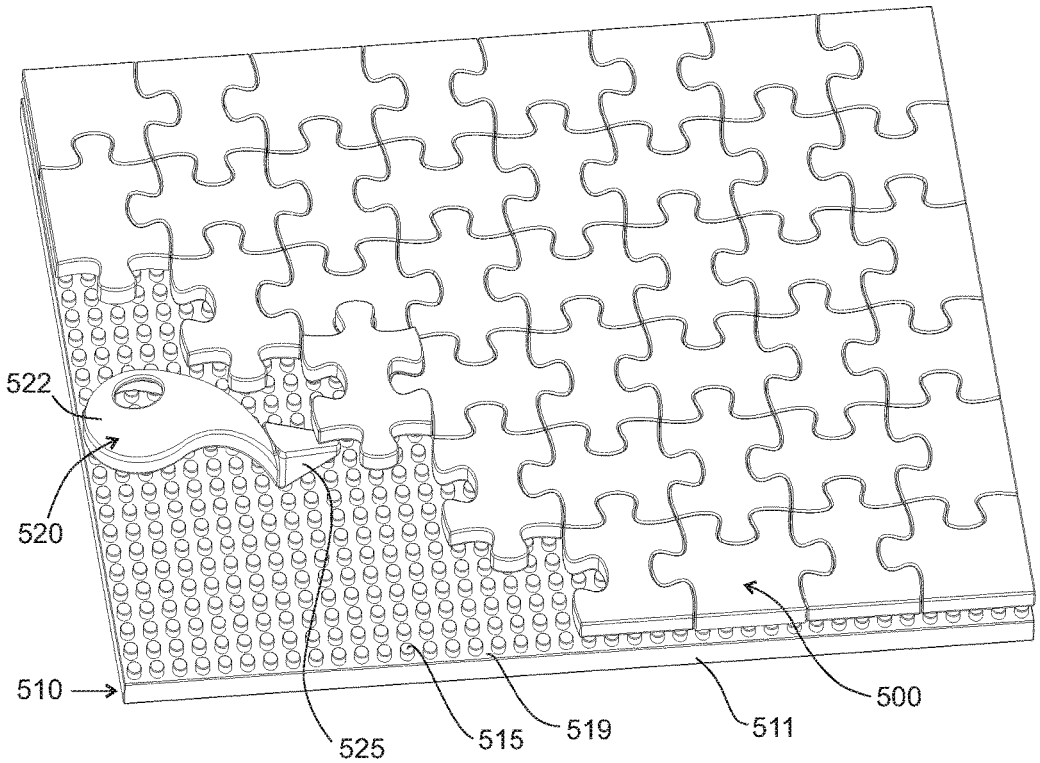
FIG. 14 is a perspective view of a pry tool removing puzzle pieces of an embodiment of the present invention.
Figure 16:
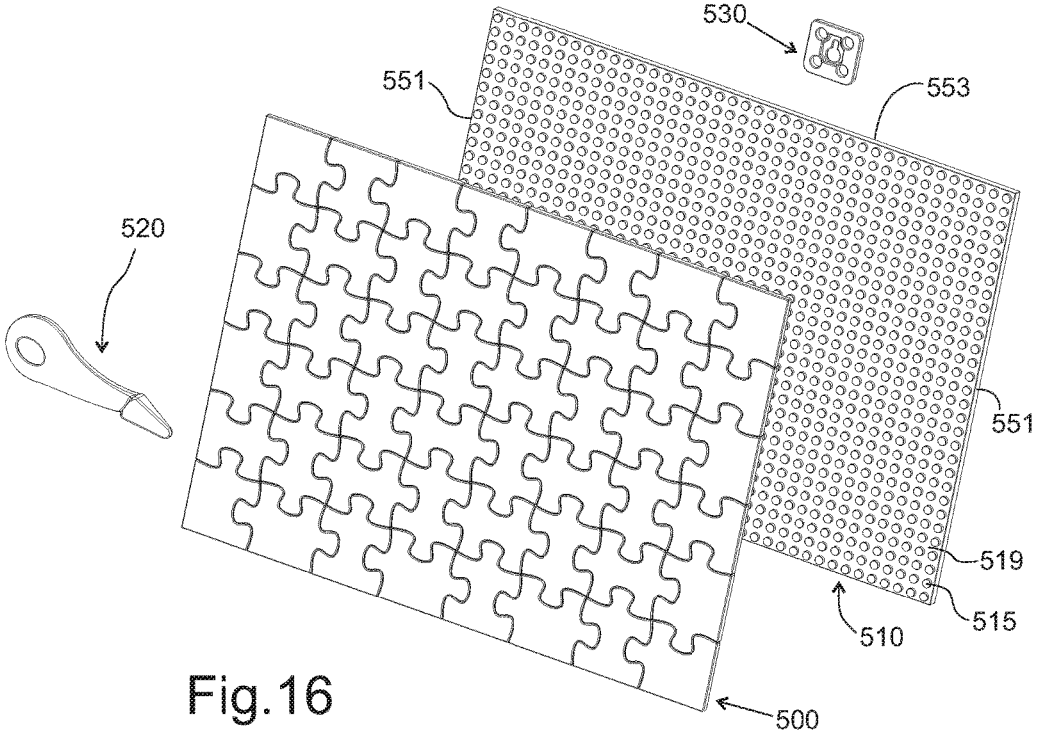
FIG. 16 is an exploded front perspective view of an embodiment of the jigsaw puzzle of the present invention including the hanger/joiner.
Figure 19:
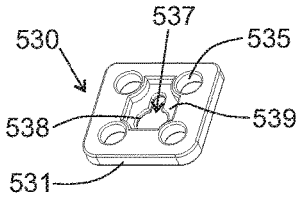
FIGS. 17-24 are left side, top side, inner perspective, inner side, bottom side, right side, outer side, and outer perspective views, respectively, of the hanger/joiner accessory of an embodiment of the jigsaw puzzle of the present invention.
Figure 18:
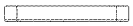
Figure 23:
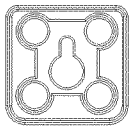
Figure 17:
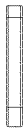
Figure 20:
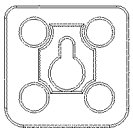
Figure 22:
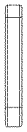
Figure 24:
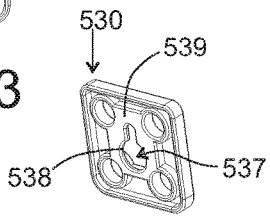
Figure 21:
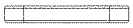
Figure 25:
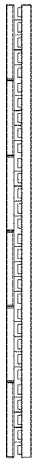
FIG. 25 is a side view of an embodiment of an embodiment of the jigsaw puzzle of the present invention.

The baseplate includes a broad, planar base foundation 512 (FIG. 6) extending left to right between opposing lateral edges 551 (FIG. 16) and extending top to bottom between opposing longitudinal edges 553 (FIG. 16). The planar base foundation 512 has a broad front surface 519 (FIG. 14), an opposing broad back portion 513 (FIG. 26), and, preferably, but optionally, an outer baseplate flange 511 for strength. The base foundation 512 is a rigid or semi-rigid sheet arranged with a number of upwardly-protruding baseplate engagement mechanisms termed "male studs 515," such as projections, pegs, knobs, protrusions, or other coupling elements. The male coupling studs 515 are preferably arranged on the front side 519 (FIG. 14) of the base foundation 512 in equidistant rows, but other arrangements can also be utilized. Optionally, but preferably, the male studs 515 are sized and shaped to complement the female engagement mechanisms of conventional modular building blocks, allowing the child to utilize the puzzle baseplate as a building block baseplate for conventional modular building blocks, as well as for a foundation for the provided set or sets of puzzle pieces 500. Each of the male studs 515 is configured to be frictionally engaged with one or more complementary engagement mechanisms 505 disposed on the rear of a puzzle piece 500.

Preferably the baseplate 510 and the baseplate engagement mechanisms are formed of a plastic material, such as ABS (acrylonitrile butadiene styrene) plastic, and are formed integrally. If needed for structural soundness, the back of baseplate 510 may be reinforced with plastic or other material as may be required for sturdiness. For example, the bottom could be formed with additional plastic added in a honeycomb or striated pattern.

Figure 1:
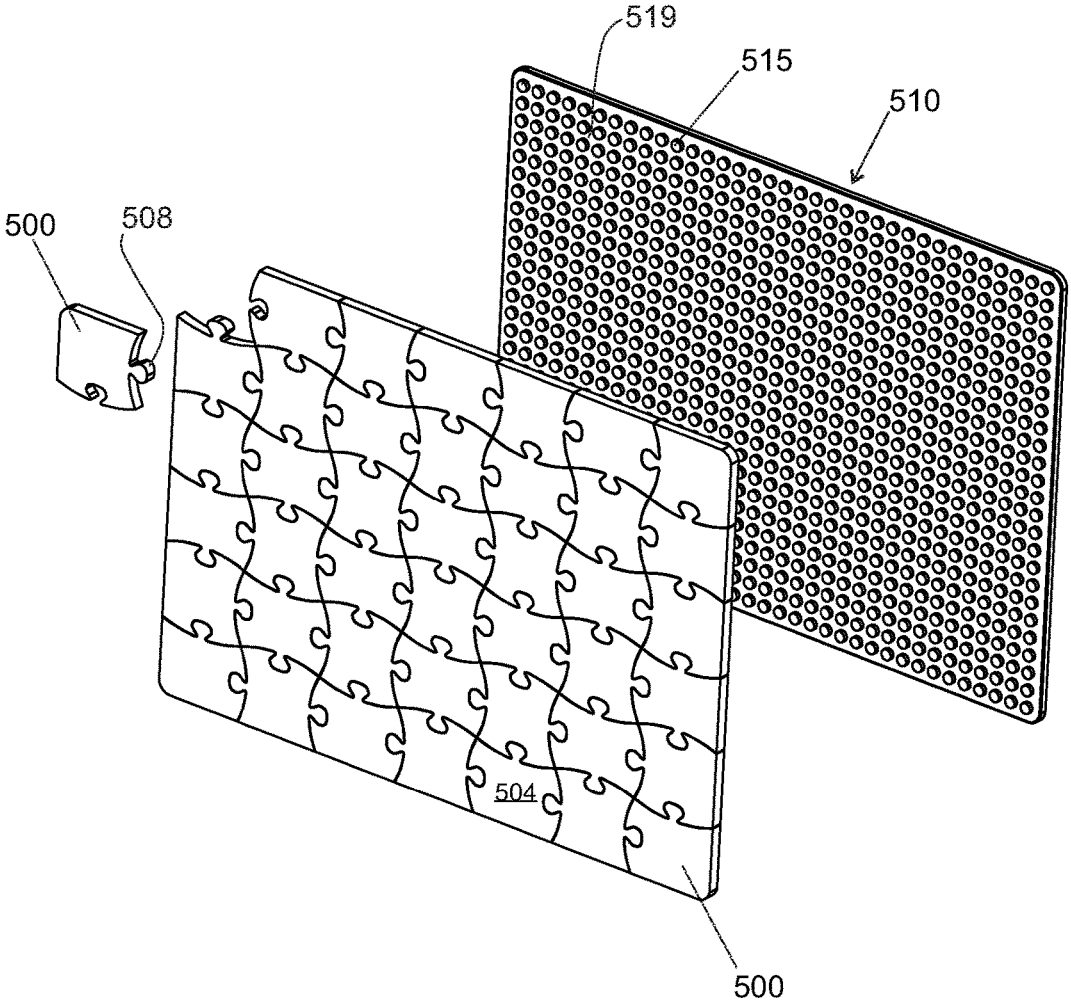
FIG. 1 is an exploded front perspective view of an embodiment of the jigsaw puzzle of the present invention.
Figure 10:
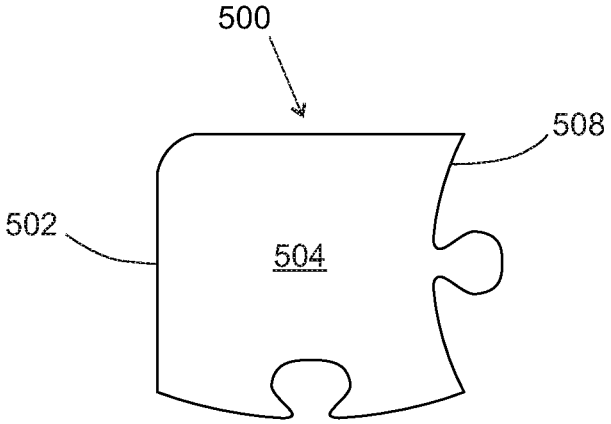
FIG. 10 is a front view of a single puzzle piece of the present invention.
Figure 11:
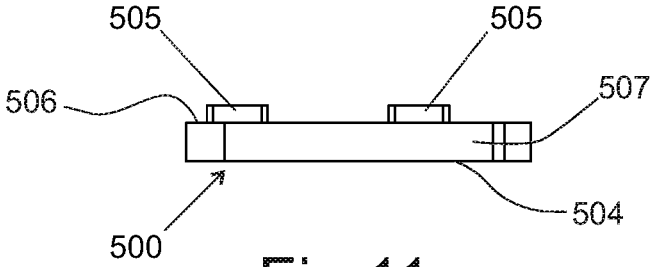
FIG. 11 is a side view of a single puzzle piece of the present invention.

The puzzle pieces have a front surface 504 (FIGS. 1, 10) and back surface 509 (FIG. 12) and outer, generally irregularly shaped lateral and longitudinal edges. A puzzle outer perimeter flange 501 forms an outer border running along all four sides of the puzzle piece (along the lateral and longitudinal edges of the puzzle piece). The height of the puzzle outer perimeter flange 501 (at least at some points, and preferably along its entire length) is less than the height of the puzzle piece engagement mechanisms 505. This provides an open area into which a fingertip, puzzle piece edge, or the tip of the pry tool 520 may be inserted.

One or multiple puzzle piece engagement mechanisms 505 are disposed on the back surface of each puzzle piece. The puzzle piece engagement mechanisms 505 are sized and configured to be frictionally engaged to the complementary baseplate male studs 515. The puzzle piece's rear-facing engagement mechanism 505 may be in any of a variety of shapes that fit over or between or otherwise frictionally engage one or more of the male studs 515. For example, the engagement mechanism 505 may comprise an open female slot, may comprise a cylindrical with inner ribs, may comprise a cylinder having an outer circumference equal to the diagonal distance between two male studs 515 to allow four outer portions of the cylinder to frictionally engage with four male studs 515, may comprise other shapes allowing portions of plastic to frictionally engage with one or more portions of the outside of the male coupling studs 515, or may in other designs that allow frictional connection with or onto the male coupling studs 515, such as the square shape shown in FIG. 13. For puzzles with smaller pieces, the preferred number of puzzle piece rear-facing engagement mechanisms 505 is four, as illustrated, but for puzzles with larger pieces, such as a preschool puzzle, the preferred number of puzzle piece rear-facing engagement mechanisms 505 is one.

In a preferred aspect, the puzzle engagement mechanism 505 includes a downwardly-protruding leg 545 (FIG. 13) that ends in a blunt leg end face 546. The baseplate's male stud 515 is an open, partially open, or solid cylinder having a cylinder wall 556 that has a height less than the height of the downwardly-protruding leg 545 of the engagement mechanism 505. Depending on the design of the complementary engagement mechanism 505 uses, the downwardly-protruding leg 545 may be an annular wall, a partial annular wall, or the downwardly-extending portion of another type of engagement mechanism 505, such as the open squared column illustrated.

The front of each puzzle piece 500 is a puzzle piece front surface 504. The piece front surface 504 preferably carries a portion of a decorative presentation (not shown) that provides artistic interest, amusement, and/or educational value, with the full decorative presentation to be completed upon accomplishing the installation of all the puzzle pieces. The graphical presentation may be applied to the front of the puzzle piece in any manner known in the art, including printing, imprinting, embossing, embellishing, painting, adherence of a label or decal, or other application means, or it may optionally be incorporated into a molded puzzle piece. Generally, the shaped lateral and/or longitudinal edges and/or the displayed portion of the top surface decorative presentation may be used by the user to determine which puzzle piece 500 should be positioned in which location upon the baseplate 510 to create the completed decorative presentation. Optionally, the puzzle piece front surfaces 504 may be left plain and unembellished to allow the child user to personalize the puzzle by creating an artistic representation of his/her own choosing.

The outer shape of the puzzle piece varies, depending on the particular jigsaw pattern chosen and on the location (interior or exterior) of the puzzle piece. The interior puzzle pieces 500 have outer locking shaped edges 508 on all four lateral and longitudinal sides, while exterior puzzle pieces 500 have outer locking shaped edges 508 on edges facing inwardly toward another puzzle piece and typically have smoother shaped edges on perimeter edges 502 facing the outside perimeter of the puzzle. The puzzle pieces are shaped in a jigsaw-type manner with the inner shaped edges 508 of one puzzle piece being the complement of an inner shaped edge 508 of the adjacent puzzle piece. The outer perimeter flange 501 (FIG. 13) is shaped in the shape (internal edge shape 508 or external edge shape 502) designated by the particular jigsaw cut design selected for the puzzle.

In contrast to a traditional jigsaw puzzle, the outer perimeter flange 501 of one puzzle piece need not very tightly abut the outer perimeter flange 501 of an adjacent puzzle piece. In a traditional jigsaw puzzle, the interlocking edges are often the only feature causing the puzzle pieces to remain in place, thus a very tight abutment is necessary. In the inventive puzzle system, the irregular outer edges help determine placement, but the complementary engagement mechanisms of the puzzle piece and baseplate are mainly responsible for maintaining the puzzle pieces in their proper places. The small separation between the flanges 501 of adjacent puzzle pieces facilitates removal of the pieces.

The engagement of the puzzle piece's engagement mechanisms 505 to the forwardly-extending male studs 515 of the baseplate attaches the puzzle pieces 500 to the baseplate 510. To disengage the puzzle pieces 500 and release them from the baseplate 510, the user may manually pry up the edge of the puzzle piece or use a pry tool 520, if provided.

Figure 27:
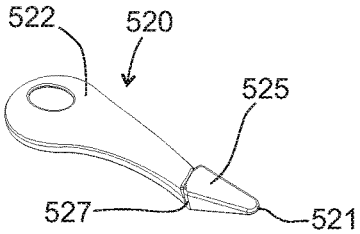
FIGS. 27-32 are top perspective, back, front, left side, top, and right side views, respectively, of the pry tool of the jigsaw puzzle of the present invention.
Figure 28:
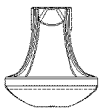
Figure 29:
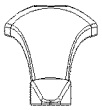
Figure 30:
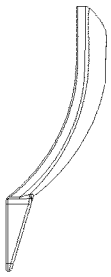
Figure 31:
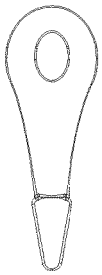
Figure 32:
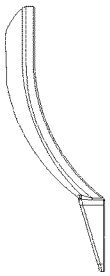

The pry tool 520, best seen in FIG. 27, may resemble an artist's palette knife. The pry tool 520 has a handle 522 permanently affixed to a wedge 525 or formed integrally with the wedge 525. The wedge 525 has a tip 521 which is inserted under the bottom edge 506 of side flange 501. As seen in the side views of FIGS. 30 and 32, the wedge 525 may be a right triangle, with the lower flat surface forming a right angle with the back 527 of the wedge and with the hypotenuse forming the angled top surface. When viewed from the top, as in FIG. 31, the wedge 525 narrows as it reaches the tip 521, thus presenting a vertically and horizontally pointed tip 521 for easy insertion into gap 200. Thus, the top of the wedge 525 (and a horizontal cross section) has an isosceles triangular shape with blunted tip and preferably back corners, and the side (and a vertical cross section) has a right triangle shape with a blunted tip for safety.

The pry tool 520 may be formed of plastic, metal, bamboo, wood, a combination of materials, or other suitable materials. All edges of the pry tool 520 are preferably rounded for safety.

Preferably the puzzle system 100 also includes a hanger/joiner 530, seen in FIGS. 16-24, 26, 42-44. The hanger/joiner 530 has a back wall 539 extending between lateral and longitudinal perimeter edges 531, which, when installed faces the wall the puzzle will be suspended from. This back wall 539 is configured with interior edges 538 defining a hanging hole 537, shown as a keyhole-type hanging hole, for receiving a nail, screw or other wall anchor by which the entire assembled puzzle system can be removably attached to the wall.

Figure 26:
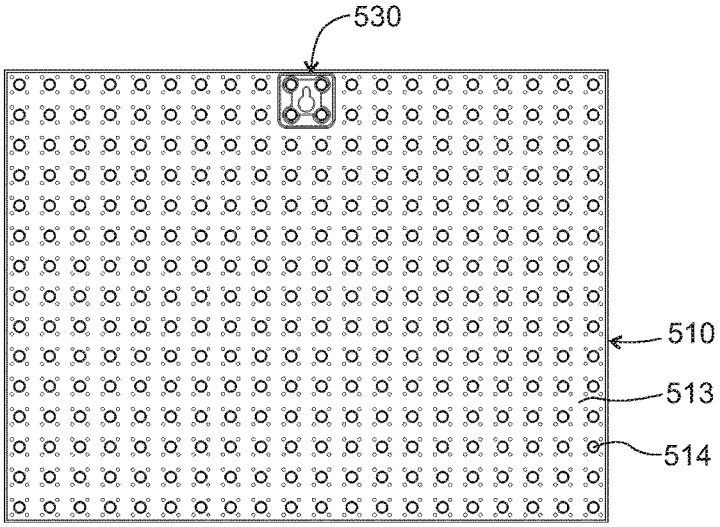
FIG. 26 is a back view of an embodiment of an embodiment of the jigsaw puzzle of the present invention showing the hanging function of an attached hanger/joiner accessory.
Figure 33:
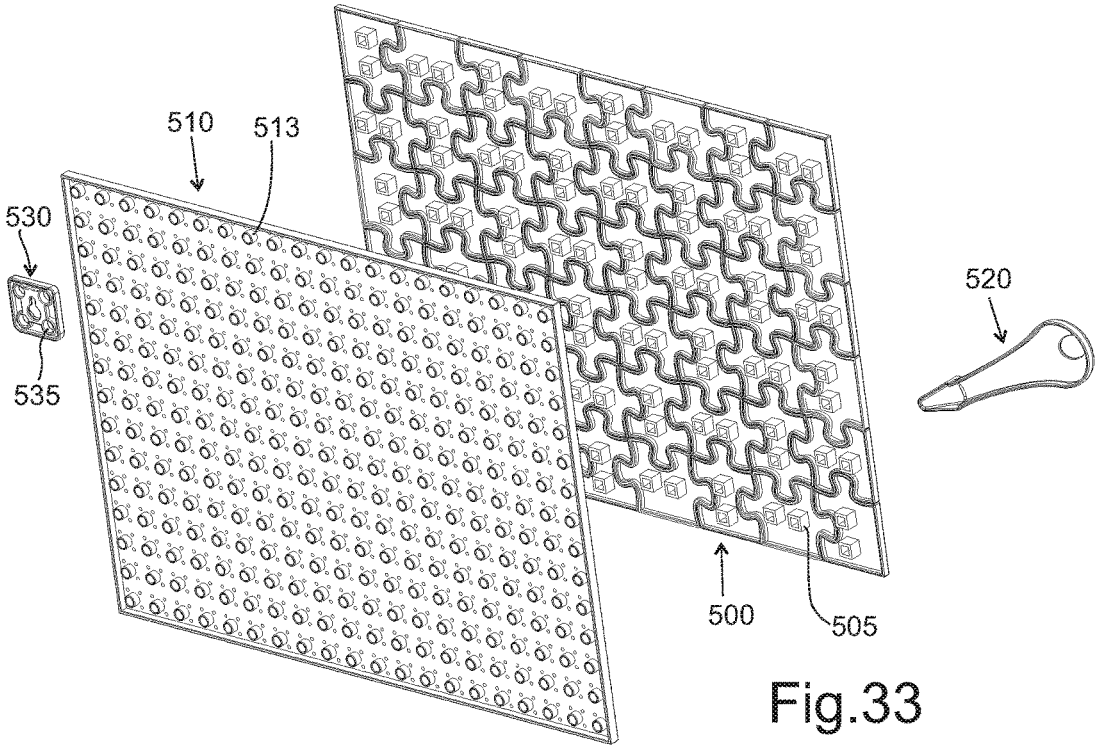
FIG. 33 is an exploded back view of an embodiment of the jigsaw puzzle of the present invention including the hanger/joiner accessory and the pry tool.
Figure 34:
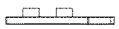
FIGS. 34-41 are top side, left side, front, bottom side, right side, front perspective, back perspective, and back views, respectively, of a puzzle piece of the present invention.
Figure 35:
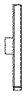
Figure 36:
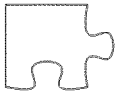
Figure 38:
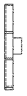
Figure 37:
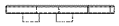
Figure 39:
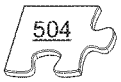
Figure 40:
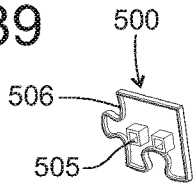
Figure 41:
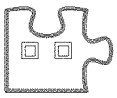
Figure 42:
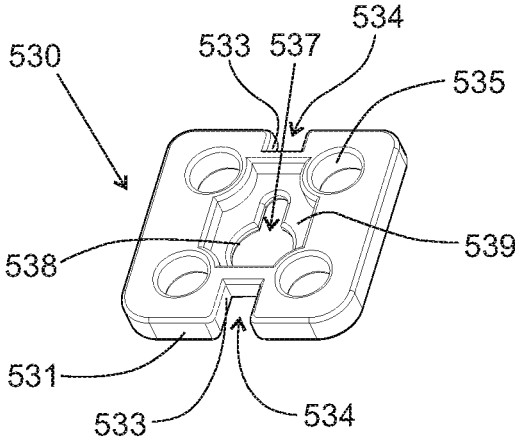
FIG. 42 is an inner perspective view of an aspect of the hanger/joiner accessory.
Figure 43:
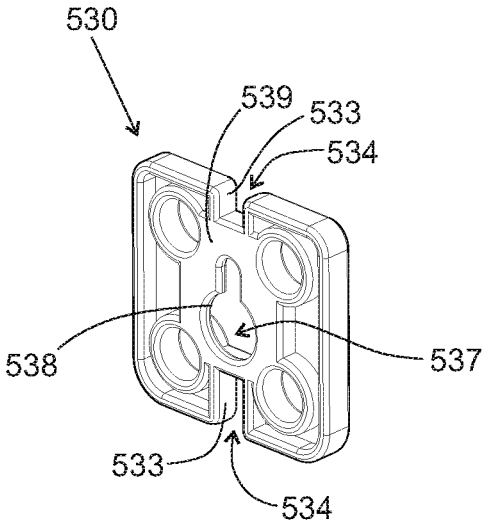
FIG. 43 is an outer perspective view of an aspect of the hanger/joiner accessory.

The hanger/joiner 530 includes multiple connecting members 535 that are the counterpart of, and are removably frictionally engageable with, multiple complementary rear connecting members 514 disposed on the baseplate rear portion 513. These baseplate complementary rear connecting members 514 are illustrated in FIGS. 26, 33 as an array of outwardly-projecting members arranged on the baseplate rear side 513 in equidistant rows, but other arrangements can also be utilized. For example, since the hanger/joiner 530 is likely to only be engaged at the center of one of the lateral or longitudinal sides of the baseplate 520, a limited number of complementary rear connecting members 514 may be disposed merely in the center of each of the lateral and longitudinal sides of the baseplate 520. Though the complementary rear connecting members 514 are illustrated as male projections, female receptacles can also be used as complementary rear connecting members 514. In that case, the multiple connecting members 535 of the hanger/joiner 530 could be any frictionally-engageable male connectors that are complementary to the female rear connecting members 514.

As shown in FIG. 26, when the hanger/joiner 530 is utilized as a hanger, the hanger/joiner 530 may be disposed within the ridge of one of the opposing lateral edges 551 or within the ridge of one of the opposing longitudinal edges 553.

Figure 44:
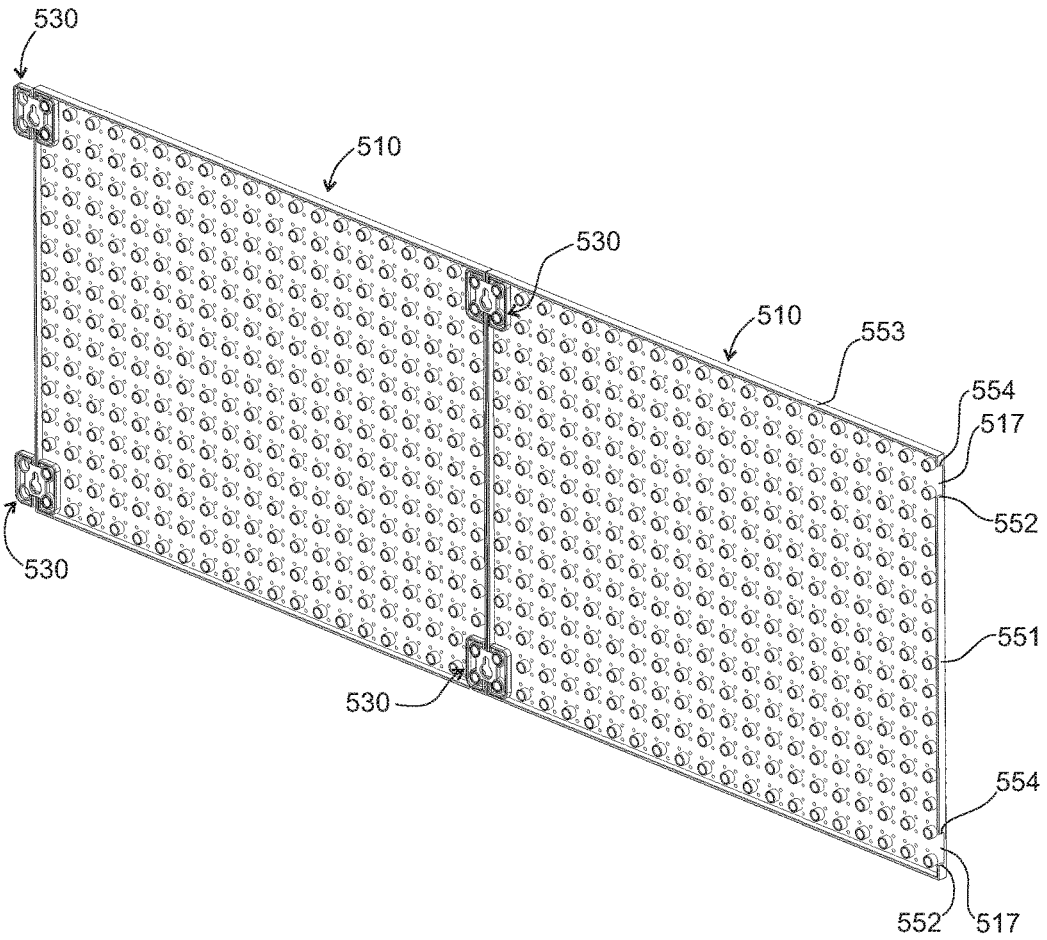
FIG. 44 is a back perspective view of two baseplates showing the joining function of the hanger/joiner accessory.

In another aspect shown in FIG. 44, when the hanger/joiner 530 is used as a joiner, two or more baseplates 510 may be joined. In the aspect depicted in FIGS. 42-44, the hanger/joiner 530 has two opposing concave portions 534 defined by edges 533 inset into two opposing walls of the hanger/joiner 530, i.e. the two opposing concave portions 534 may be disposed on opposing lateral perimeter edges 531 or disposed on opposing longitudinal perimeter edges 531.

Also, in this aspect, the baseplates 510 may be configured with a flat edge portion 517 that is inset within the wall of the opposing lateral edges 551, as shown, and/or opposing longitudinal edges 553. When the flat edge portion 517 is inset within the baseplate edges, a first boundary 552 and second boundary 554 is formed. The boundaries 552, 554 are the ends of the walls 551 and/or 553 located at the opposing ends of the flat edge portion 517. It may be visualized that the walls 551 and/or 553 are cut at boundaries 552, 554, though typically, the mold would be formed in this manner. Thus, in this aspect, the walls of the lateral 551 and/or longitudinal edges 553 do not completely surround the baseplate, but are configured with at least one and preferably two or more thinner, flat edge portions 517 along a portion of their length. The flat edge portions 517 may have a length that is significantly smaller than the length of the edges 551, 553, but that is equal to or slightly larger than the distance between the two opposing concave portions 534 defined by edges 533 of the hanger/joiner 530. To connect two baseplates 510, the two opposing concave portions 534 are aligned with the flat edge portion 517, the multiple connecting members 535 on a first lateral side of the hanger/joiner 530 are engaged with the complementary rear connecting members 514 of a first baseplate 510, and the multiple connecting members 535 on the opposing second lateral side of the hanger/joiner 530 are engaged with the complementary rear connecting members 514 of a second baseplate 510. Preferably, as shown in FIG. 44, two hanger/joiners 530 are used to secure two baseplates 510.

To use the inventive studded jigsaw puzzle system 100, the user obtains at least one baseplate 510 and a first set of coordinating puzzle pieces 500. The user assembles the coordinating puzzle pieces 500 using the shaped edges 508 and any pictorial or graphical presentation on the front surface 504 of the puzzle piece for guidance. The user may also use designations on the baseplate top surface 519 applied to or integrally formed with the baseplate 510, if provided.

As each coordinating puzzle piece 500 is placed, the user presses downward on the top surface 504 to engage the puzzle piece's rear-facing engagement mechanisms 505 with the baseplate's male studs 515. Though it may not be obvious to the user, a small gap 200 remains between the puzzle piece and the baseplate. If the user wants to remove a puzzle piece for any reason (such as, a misplaced piece), the user utilizes the pry tool 520 by slipping the tip 521 into the gap 200. The tip 521 may be slipped under an edge puzzle piece or between two adjacent interior puzzle pieces, and may be inserted from any of the four sides of any puzzle piece 500.

After the pry tool 520 is inserted, the user pushes downward on the handle 522, which causes the tip 521 to engage with the bottom surface 506 of the puzzle piece side flange 501. The pry tool 520 acts as a lever, thus little force is needed to disengage the puzzle piece's rear-facing engagement mechanisms 505 from the baseplate's male studs 515. This is in contrast to the much larger effort that would be required to pull upward on the puzzle piece side flange 501, which is narrow and difficult to grip, to disengage the complementary engagement mechanisms 505, 515. The same lever principal applies when, optionally, the user uses the edge of a puzzle piece or uses a fingertip to engage with gap 200 and pry the puzzle piece upward.

Figure 9:
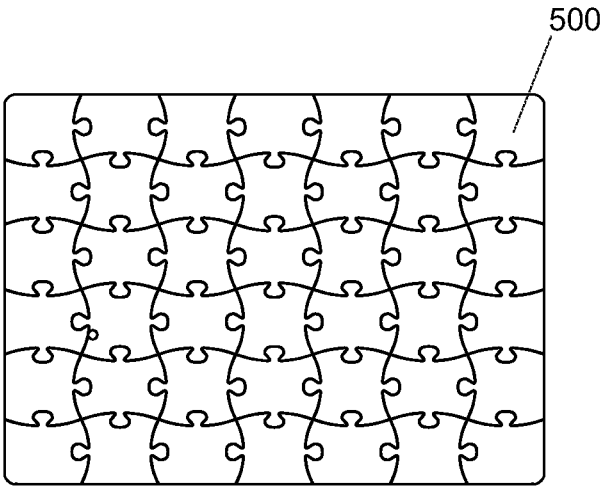
FIG. 9 is a front view of an embodiment of the present invention.

When all the coordinating puzzle pieces are placed onto the baseplate and the puzzle composition is completed (FIG. 9), the cohesive puzzle unit will be able to be displayed vertically or stored in any position without losing puzzle pieces. When in the storage or display mode, the pieces will not fall out if the puzzle is turned upside down, turned on one of its sides, or stored or displayed vertically.

After storage or display, when using the pry tool 520, if the user wishes to repeat the assembly of the puzzle, the user slips the tip 521 of the pry tool 520 under the bottom surface 506 of the puzzle piece side flange 501 of an interior or exterior puzzle piece. The user pushes downward to remove a first piece, shown as an exterior puzzle piece in FIG. 2. By this method, one, multiple, or all the puzzle pieces 500 can be removed from the baseplate 510.

Though the puzzle system is illustrated with forty-two puzzle pieces 500, the number and size of the puzzle pieces 500 can vary depending on the age and abilities of the user, whether child or adult.

The puzzle pieces 500 are preferably formed of plastic, such as ABS (acrylonitrile butadiene styrene) plastic, but paperboard, laminated paperboard, cardboard, wood, layered compositions, and other materials can be used. Preferably, the puzzle pieces 500 will be injection molded as one piece with a narrow space between the puzzle pieces 500 and narrow bridges connecting the adjacent pieces 500. This will result in the puzzle pieces 500 being connected like a web. The web of puzzle pieces 500 can then be printed in full color, such as on a color printer, and then the puzzle pieces 500 can be die cut apart. If needed, heat may be used in the die-cut process to remove the bridges and ensure a smooth edge on the puzzle pieces.

Optionally, the baseplate 510 may be made modularly and may be assembled into the larger baseplate shown in FIG. 44 by the user. This modular design of the baseplate advantageously enables the use of smaller mold tools and of smaller packaging, which provides advantages in shipping efficiency and in shelf display. In this aspect, two or more baseplates are obtained and joined by at least one, and preferably two, hanger/joiners 530. A first hanger/joiner 530 is aligned with the flat edge portion 517 of the baseplate, with the first boundary 552 and second boundary 554 of the baseplate edge aligned with, and fitting into, the two opposing concave portions 534 so that the connecting members 535 on a first side of the hanger/joiner 530 are engaged with the complementary rear connecting members 514 of a first baseplate 510 and so that the connecting members 535 on the opposing second lateral side of the hanger/joiner 530 are engaged with the complementary rear connecting members 514 of a second baseplate 510. As shown in FIG. 44, a second hanger/joiner 530 is engaged in the same manner.

The invention illustratively disclosed herein may be suitably practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A puzzle system comprising:

a baseplate comprising a broad, planar base foundation extending left to right between opposing lateral edges and extending top to bottom between opposing longitudinal edges and including a front surface and a back portion; said baseplate further comprising multiple rear connecting members disposed on said back portion; and said baseplate further comprising a number of upwardly-protruding male studs protruding from said front surface;

a first set of coordinating puzzle pieces, each of said puzzle pieces having a front surface, opposing back portion, and shaped outer edges; wherein said back portion comprises at least one puzzle piece engagement mechanism that is complementary to said male studs and manually engageable with at least one of said male studs; wherein the height of said at least one puzzle piece engagement mechanism is greater than the height of said male studs; wherein, upon manual installation of one of said puzzle pieces onto said baseplate, the height of said at least one puzzle piece engagement mechanism causes the creation of a small gap between said puzzle pieces and said front surface of said baseplate; and a hanger/joiner comprising a back wall having interior edges defining a hanging hole and comprising multiple complementary front connecting members that are complementary to, and manually engageable with, multiple ones of said multiple rear connecting members of said baseplate; wherein said hanger/joiner comprises four outer walls; wherein two opposing ones of said four outer walls are configured with opposing concave portions defined by concave edges; wherein at least one of said two opposing lateral edges and said opposing longitudinal edges of said baseplate comprises a wall configured with at least two flat edge portions; and wherein each of said at least two flat edge portions is sized to accommodate said hanger/joiner.

2. The puzzle system, as recited in claim 1, wherein said multiple rear connecting members of said back portion of said baseplate comprise at least four of said multiple rear connecting members.

3. The puzzle system, as recited in claim 1, further comprising a pry tool having a handle with a proximal and distal end and a wedge disposed at said distal end; wherein said wedge ends in a narrowed tip that is sized and configured to be manually engaged within said small gap.

4. The puzzle system, as recited in claim 1, wherein:

said male stud comprises a cylinder having an upwardly-projecting outer wall having a wall height;

said at least one puzzle piece engagement mechanism comprises at least one downwardly-extending leg having a leg height; and the measurement of said wall height is less than the measurement of said leg height.

5. The puzzle system, as recited in claim 4, wherein:

each of said puzzle pieces includes an outer perimeter flange extending along said shaped outer edges;

said perimeter flange extends vertically from said front surface of said puzzle piece rearwardly to end at a flange bottom edge to define a perimeter flange height; and the measurement of said perimeter flange height is less than the measurement of said leg height.

6. The puzzle system, as recited in claim 1, further comprising a second set of coordinating puzzle pieces configured for use with said baseplate.

7. The puzzle system, as recited in claim 1, wherein said upwardly-protruding male studs are arranged in an array of equidistant rows.

8. The puzzle system, as recited in claim 1, wherein said at least one puzzle piece engagement mechanism comprises at least four of said at least one puzzle piece engagement mechanism.

9. A puzzle system comprising:

a baseplate comprising a broad, planar base foundation extending left to right between opposing lateral edges and extending top to bottom between opposing longitudinal edges and including a front surface and a back portion; said baseplate further comprising multiple rear connecting members disposed on said back portion; and said baseplate further comprising a number of upwardly-protruding male studs protruding from said front surface; wherein said opposing lateral edges and said opposing longitudinal edges of said baseplate comprise walls that do not completely surround said baseplate; and wherein said baseplate comprises at least two flat edge portions, each of which is bordered by a first wall boundary and a second wall boundary;

a first set of coordinating puzzle pieces, each of said puzzle pieces having a front surface, opposing back portion, and shaped outer edges; wherein said back portion comprises at least one puzzle piece engagement mechanism that is complementary to said male studs and manually engageable with at least one of said male studs; wherein the height of said at least one puzzle piece engagement mechanism is greater than the height of said male studs; wherein, upon manual installation of one of said puzzle pieces onto said baseplate, the height of said at least one puzzle piece engagement mechanism causes the creation of a small gap between said puzzle pieces and said front surface of said baseplate; and a hanger/joiner comprising a back wall having interior edges defining a hanging hole and comprising multiple complementary front connecting members that are complementary to, and manually engageable with, multiple ones of said multiple rear connecting members of said baseplate; wherein said hanger/joiner comprises four outer walls; wherein two opposing ones of said four outer walls are configured with opposing concave portions defined by concave edges; and wherein a length between said first wall boundary and said second wall boundary is greater than the length between said opposing concave portions, thereby allowing insertion of said hanger/joiner into one of said at least two flat edge portions.

10. A puzzle system comprising:

a baseplate comprising a broad, planar base foundation extending left to right between opposing lateral edges and extending top to bottom between opposing longitudinal edges and including a front surface and a back portion; said baseplate further comprising a number of upwardly-protruding male studs protruding from said front surface; said male studs having an upwardly-projecting outer wall having a stud wall height; said back portion comprising at least four rear connecting members;

a first set of coordinating puzzle pieces, each of said puzzle pieces having a front surface, opposing back portion, and shaped lateral and longitudinal outer edges; wherein said back portion comprises at least one puzzle piece engagement mechanism that is complementary to said male studs and manually engageable with said male studs; wherein said at least one puzzle piece engagement mechanism comprises at least one downwardly-extending leg having a leg height; wherein the measurement of said leg height is greater than the measurement of said stud wall height; wherein, upon manual installation of one of said puzzle pieces onto said baseplate, the height of said at least one puzzle piece engagement mechanism causes a creation of a small gap between a rear portion of said one of said puzzle pieces and said front surface of said baseplate; and a hanger/joiner comprising a back wall having interior edges defining a hanging hole and comprising multiple complementary front connecting members that are complementary to said at least four rear connecting members of said baseplate and that are manually engageable with said at least four rear connecting members of said baseplate; wherein said hanger/joiner comprises four outer walls; wherein two opposing ones of said four outer walls are configured with opposing concave portions defined by concave edges; and wherein at least one of said two opposing lateral edges and said opposing longitudinal edges of said baseplate comprises a ridged wall configured with at least two flat edge portions sized to accommodate said hanger/joiner.

11. The puzzle system, as recited in claim 10, further comprising a pry tool having a handle with a proximal and distal end; wherein said distal end is formed as a wedge ending in a narrowed tip sized and configured to be manually engaged within said small gap.

12. The puzzle system, as recited in claim 11, wherein:

a horizontal cross section of said wedge of said pry tool is in the shape of a triangle with a blunted distal point; and a vertical cross section of said wedge of said pry tool is in the shape of a right triangle with a blunted distal point and with the hypotenuse positioned upwardly.

13. The puzzle system, as recited in claim 10, wherein:

each of said puzzle pieces includes an outer perimeter flange extending along said shaped lateral and longitudinal outer edges;

said perimeter flange extends vertically from said front surface of said puzzle piece rearwardly to end at a flange bottom edge to define a perimeter flange height; and the measurement of said perimeter flange height is less than the measurement of said leg height.

14. The puzzle system, as recited in claim 10, further comprising a second set of coordinating puzzle pieces configured for use with said baseplate.

15. The puzzle system, as recited in claim 10 wherein said upwardly-protruding male studs are arranged in an array of equidistant rows.

16. The puzzle system, as recited in claim 10, wherein:

said opposing lateral edges and said opposing longitudinal edges of said baseplate comprise walls; and at least one of said two opposing lateral edges and said opposing longitudinal edges of said baseplate comprises at least two flat edge portions.

* * * * *